United States Patent [19]

Zepf

[11] 4,103,442

[45] Aug. 1, 1978

[54] ADJUSTABLE SHOVEL TOOTH CAP HOLDER

[76] Inventor: Hans-Rudolf Zepf, Hirsackerstrasse 30, Horgen, Switzerland

[21] Appl. No.: 783,567

[22] Filed: Apr. 1, 1977

[30] Foreign Application Priority Data

Apr. 12, 1976 [CH] Switzerland ..... 4616/76

[51] Int. Cl.[2] ..... E02F 9/28

[52] U.S. Cl. ..... 37/142 R

[58] Field of Search ..... 37/141 R, 142 R, 142 A, 37/141 T

[56] References Cited

U.S. PATENT DOCUMENTS

| | | | |
|---|---|---|---|
| 1,107,253 | 8/1914 | Black | 37/142 R |
| 1,188,480 | 6/1916 | Pemberton | 87/14 R |
| 1,419,047 | 6/1922 | Hanks et al. | 37/142 R |
| 1,485,879 | 3/1924 | Page | 37/142 R |
| 1,507,697 | 9/1924 | Crane | 37/142 R |
| 1,815,820 | 7/1931 | Andersen | 37/142 R |
| 1,837,341 | 12/1931 | Shaffer | 37/142 R |
| 1,856,930 | 5/1932 | Robin | 37/142 R |
| 2,211,786 | 8/1940 | Lehman et al. | 37/141 T |
| 2,227,674 | 1/1941 | Ratkowski | 37/142 R |
| 2,674,816 | 4/1954 | Daniels et al. | 37/142 A |
| 3,368,293 | 2/1968 | Judkins et al. | 37/142 R |
| 3,748,763 | 7/1973 | Zepf | 37/142 R |

FOREIGN PATENT DOCUMENTS

| | | | |
|---|---|---|---|
| 2,253,883 | 7/1975 | France | 37/141 T |
| 1,801,601 | 5/1970 | Fed. Rep. of Germany | 37/142 R |
| 1,205,070 | 9/1970 | United Kingdom | 37/142 R |

*Primary Examiner*—Clifford D. Crowder

*Attorney, Agent, or Firm*—Roylance, Abrams, Berdo & Farley

[57] ABSTRACT

A shovel tooth includes a tooth holder having a front portion to receive a tooth cap, a rear portion having edges weldable to the inner surface of a shovel blade and a transverse web between the front and rear portions. A second rear portion, formed separately, is a hollow shell having edges weldable to the outer surface of the shovel and a front edge weldable to the web to permit the holder to be attached to blades of various thicknesses. The web can be concave and the front edges of the second rear portion convex to mate with the web. The blade can be notched.

7 Claims, 6 Drawing Figures

ADJUSTABLE SHOVEL TOOTH CAP HOLDER

This invention relates to a shovel tooth and, more specifically, to a shovel tooth attachable to shovel blades of various widths.

BACKGROUND OF THE INVENTION

In copending U.S. patent application Ser. No. 656,793, filed Feb. 10, 1976 now abandoned, but refiled as a continuation, U.S. patent application Ser. No. 805,473 on June 10, 1977, there is disclosed a shovel tooth having a tooth holder portion extending forwardly from the shovel blade on which a tooth cap can be detachably fitted, a transverse web, and a rear portion fixedly attachable to the shovel blade, the rear portion being constructed as a U-shaped hollow shell with the free edges of the legs of the shell portion being fixedly connected with the shovel blade, as by welding. The web extends across and covers the edge of the shovel blade and provides support for the cap-holding portion.

The shovel tooth described therein can be used as a standard shovel tooth for equipping the shovels of equipment such as traveling loaders and excavators or dredging machines. If, however, very powerful forces act on the shovel tooth and are directed against the inside of the shovel or scoop, it is occasionally possible that the connection between the shovel tooth and the blade or scoop can become damaged. In order to provide adequate strength to withstand such extreme stresses, it is known to use teeth having a rear holder part on both the inside and the outside thereof. However, a disadvantage of such structures is that they can be used essentially only with a shovel blade having about the same wall thickness as the space between the two rear portions which must fit over the blade. This means that for each shovel blade wall thickness a different tooth model must be provided.

It is also known to use a cast lip instead of a shovel blade, as shown in U.S. Pat. No. 2,145,663. In this case the lip has thickened portions corresponding approximately to the two rear holder parts and is inserted in the front portion of the tooth. However, in the case of cast blades it is also disadvantageous that a different model is required for each construction. In addition, the service life of cast lips is considerably inferior to that of rolled blades.

BRIEF SUMMARY OF THE INVENTION

Accordingly, it is an object of the present invention to provide a shovel tooth of the general type previously described wherein a relatively few standard sizes need be provided whereby it is possible to equip shovel blades having a relatively large range of wall thicknesses with shovel teeth without losing the advantages of forged shovel teeth.

Briefly described, the invention includes a shovel tooth of the type comprising a tooth holder attachable to a shovel blade and a tooth cap replaceably attached to the tooth holder, the tooth holder comprising a front portion adapted to receive a tooth cap, a first rear portion shaped to lie against one surface of the shovel blade, a transverse web between said front and rear portions, and a separately formed second rear portion comprising a hollow shell having parallel legs adapted to lie against the opposite surface of said shovel blade and a front surface shaped to abut said web, the first and second rear portions being fixedly connectable to the respective surfaces of said blade and the second rear portion being fixedly connectable to the web whereby the holder is attachable to blades of different thicknesses.

BRIEF DESCRIPTION OF THE DRAWINGS

In order that the manner in which the foregoing and other objects are attained in accordance with the invention can be understood in detail, a particularly advantageous embodiment thereof will be described with reference to the accompanying drawings, which form a part of this specification, and wherein.

DETAILED DESCRIPTION OF THE DRAWINGS

Figure 3:
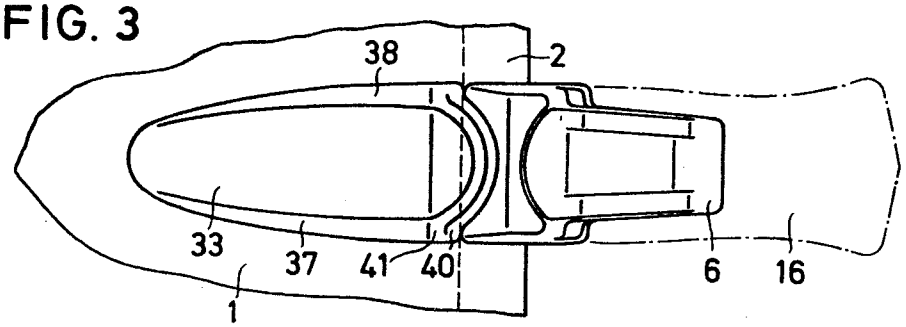
FIG. 3 is a bottom plan view of the blade tooth of FIG. 1.
Figure 1:
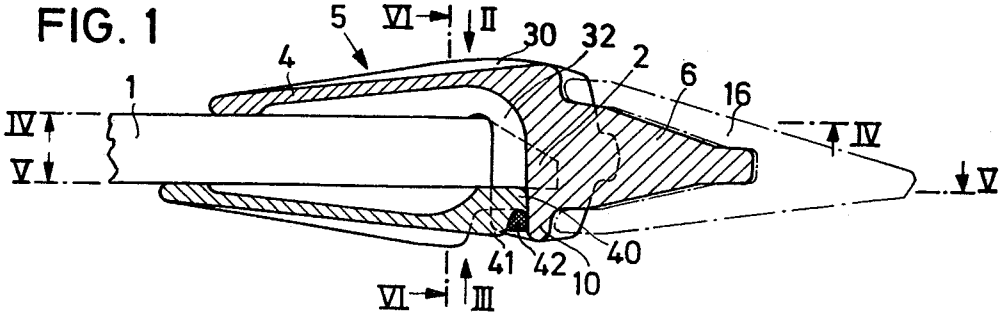
FIG. 1 is a side elevation, in partial section, of a blade and blade tooth in accordance with the invention.
Figure 2:
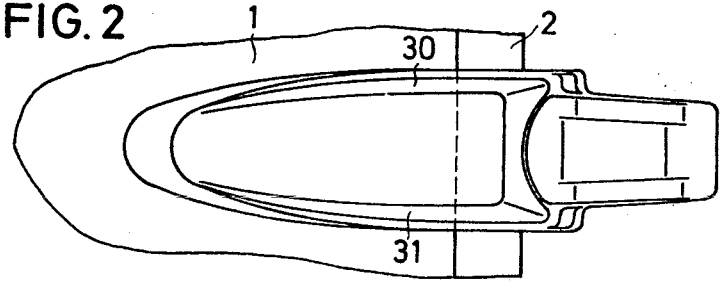
FIG. 2 is a top plan view of the blade tooth of FIG. 1.

FIG. 1 shows a shovel blade 1 having a chamfered portion 2 along the front edge of the blade, the front edge having been notched or recessed to receive the shovel tooth. The shovel tooth includes a tooth holder 5 having a rear portion 4 which lies against the upper or inner surface of the blade and is formed as a hollow shell having side edges which contact the blade surface. A forwardly extending wedge-shaped front portion 6 is formed on the tooth holder to receive a tooth cap 16 which is attachable to the holder as by means not specifically shown herein but described in copending application Ser. No. 656,793.

Figure 4:
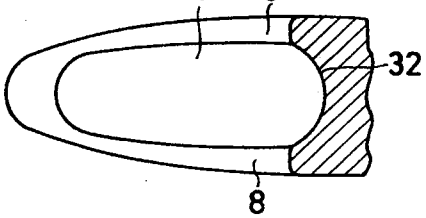
FIG. 4 is a bottom plan view, in partial section, along line IV—IV of FIG. 1.
Figure 6:
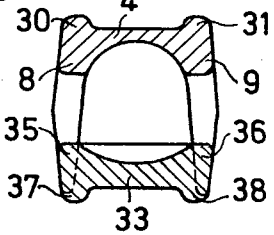
FIG. 6 is a rear elevation, in section, along line VI—VI of FIG. 1.

The rear portion 4 is constructed as a U-shaped half shell having legs 8 and 9 (FIGS. 4 and 6) which extend along the length of the rear part. Rear part 4 is fixedly connected to the inner surface of shovel blade 1 along legs 8 and 9 as by welding. As best seen in FIG. 6, legs 8 and 9 are structurally reinforced by longitudinally extending ribs 30 and 31 which protrude from the outer surface of the shell.

Between the rear portion and the cap-receiving front portion is a transverse web 10 which extends across the front portion of the shovel blade and forms a division between, and support for, the front and rear portions of tooth holder 5.

As can be seen in FIG. 1, the cavity of rear portion 4 formed by the two legs 8 and 9 is terminated at its forward portion by the transverse web 10. A concave surface 32 forms the rear surface of web 10. Concave surface 32 forms a stop face which cooperates with a second rear portion 33 which is mounted on the outside of shovel blade 1. Second rear portion 33 is, as shown in FIG. 6, also constructed as a U-shaped half shell having legs 35 and 36 which extend along the lateral edges thereof and pass into peripheral ribs 37 and 38 on the outer portion of rear portion 33. It will be observed that portion 33 is formed separately from the remainder of the tooth holder.

Figure 5:
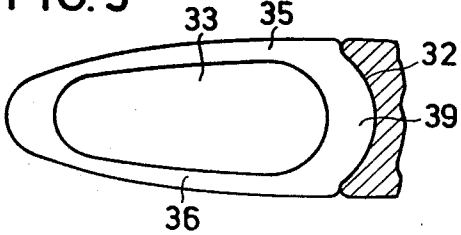
FIG. 5 is a top plan view, in partial section, along line V—V of FIG. 1.

As can best be seen in FIG. 5, the front end 39 of portion 33 comprises a flange 40 having a forward edge 39 which is convex and which is shaped to conform to and correspond with stop face 32. Thus, the front edge 39 abuts stop face 32 on web 10. As seen in FIG. 1, the flange lies inwardly of the outer surface of portion 33 so that a shoulder 41 of portion 33, along with the distal edge of web 10 and flange 40, forms a groove in which a bead forming a welding seam 42 can be provided to form a secure connection between part 33 and web 10. Shoulder 41 smoothly passes into the two exterior ribs 37 and 38.

Because of the fact that rear portion 33 is formed as a separate part, it can be engaged on stop face 32 at a position corresponding to the wall thickness of blade 1. It is thus possible to use the shovel tooth with blades having various wall thicknesses without the necessity of using different tooth holder sizes for each blade.

Due to the fact that stop face 32 is concave, welding seam 42 located adjacent flange 40 is also curved. Thus, a higher breaking strength is obtained at this point than if the welding seam 42 was linear and ran approximately to the edge of shovel blade 1.

As can be seen in FIG. 1, the second rear part 33 is longer than rear portion 4 so that the edges of legs 35 and 36 engaging with shovel blade 1 and along which part 33 is welded to blade 1 are correspondingly longer than the welded edges of legs 8 and 9.

Due to the special construction of shovel tooth 5 with a rear portion 4 and a further rear portion 33 on the outside of shovel blade 1, an extremely strong mounting of the tooth is obtained. It is thus possible to absorb without damage the extreme stresses which can occur when using power shovels. The special construction of parts 4 and 33 makes it possible to forge these components, thereby leading to a much longer service life than in the case of cast tooth mounting.

The removal of a portion of the chamfered edge 2 of shovel blade 1 brings about an increase in the welding seam length of part 4 and this extends into the area of tooth cap 16. Rear portion 4 can obviously also be welded without removing or notching chamfer 2. It is also possible, if the wall thickness of the shovel blade 1 is known in advance, to first weld the rear portion 33 to the web and to then mount the thus formed fork tooth holder on blade 1 and weld the preassembled structure to the blade.

The construction of legs 8 and 9 and 35 and 36 as supporting structures makes it possible to make the intermediate portions of parts 4 and 33 relatively thin with a corresponding saving of material.

While one advantageous embodiment has been chosen to illustrate the invention, it will be understood by those skilled in the art that various changes and modifications can be made therein without departing from the scope of the invention as defined in the appended claims.

What is claimed is:

1. A shovel tooth cap holder attachable to a shovel blade for supporting a tooth cap replaceably attachable to the tooth holder, the tooth holder comprising a front portion adapted to receive a tooth cap;

a first rear portion shaped to lie against one surface of the shovel blade;

a transverse web between said front and rear portions, said web having front and rear surfaces and upper and lower ends, said front portion coupled to and extending forwardly from said web front surface, said first rear portion coupled to and extending rearwardly from said web upper end; and a separately formed second rear portion comprising a hollow shell having parallel legs adapted to lie against the opposite surface of said shovel blade and a front surface shaped to abut only a portion of said web rear surface to permit said front surface of said second rear portion to be located adjacent any portion of said web rear surface to enable the spacing between said first and second rear portions to be varied, said first and second rear portions being fixedly connectable to the respective surfaces of said blade and said second rear portion being fixedly connectable to any portion of said rear surface of said web whereby said holder is attachable to blades of different thicknesses.

2. A shovel tooth cap holder according to claim 1 wherein said first and second rear portions are connectable to said blade and said second portion is connectable to said web by welding.

3. A shovel tooth cap holder according to claim 1 wherein the rear surface of said web is concave and said front surface of said second rear portion is correspondingly convex so that said convex and concave surfaces mate.

4. A shovel tooth cap holder according to claim 1 wherein said front surface of said second rear portion comprises a forwardly extending flange adapted to abut said web inwardly of said lower end to form a groove for welding connection of said flange to said web.

5. A shovel tooth cap holder according to claim 1 wherein said second rear portion further comprises ribs extending along opposite longitudinal edges of the outer surface of said shell parallel with said legs.

6. A shovel tooth cap holder according to claim 1 wherein said second rear portion is longer than said first rear portion.

7. A shovel tooth cap holder according to claim 1 wherein the holder is attached to a shovel blade and said blade is provided with a chamfered edge portion and is notched to the depth of said edge portion to receive said tooth holder.

* * * * *